US006065382A

United States Patent [19]

Titz et al.

[11] Patent Number: 6,065,382

[45] **Date of Patent: *May 23, 2000**

[54] CROSS CUTTER FOR WEB STOCK, IN PARTICULAR FOR A CORRUGATED CARDBOARD WEB

[75] Inventors: Felix Titz, Weiherhammer; Hans Mosburger, Weiherhammer Opf., both of Germany

[73] Assignee: BHS Corrugated Maschinen-und Anlagenbau GmbH, Weiherhammer/Opf., Germany

[ * ] Notice: Under 35 U.S.C. 154(b), the term of this patent shall be extended for 913 days.

[21] Appl. No.: 08/523,907

[22] Filed: Sep. 6, 1995

Related U.S. Application Data

[63] Continuation of application No. 08/159,140, Nov. 30, 1993, abandoned.

[30] Foreign Application Priority Data

Nov. 30, 1992 [DE] Germany ..... P 42 40 232

[51] Int. Cl.[7] ..... B26D 1/25

[52] U.S. Cl. ..... 83/341; 83/343; 83/673

[58] Field of Search ..... 83/343, 341, 345, 83/694, 674, 673, 698.42; 492/50, 53, 59

[56] References Cited

U.S. PATENT DOCUMENTS

| | | | |
|---|---|---|---|
| 3,321,145 | 5/1967 | Gorman | 83/674 |
| 3,769,868 | 11/1973 | Hornung | 83/674 |
| 4,312,256 | 1/1982 | Herzog et al. | 83/694 |
| 4,319,507 | 3/1982 | Kondo et al. | 83/694 |
| 4,426,897 | 1/1984 | Littleton . | |
| 4,756,219 | 7/1988 | Pohl et al. . | |
| 4,963,210 | 10/1990 | Corr et al. . | |
| 5,061,533 | 10/1991 | Gomi et al. | 492/53 |
| 5,230,456 | 7/1993 | Germann et al. | 226/95 |

FOREIGN PATENT DOCUMENTS

| | | |
|---|---|---|
| 0069976 | 1/1983 | European Pat. Off. . |
| 2546101 | 11/1984 | France . |
| 814236 | 9/1951 | Germany . |
| 2825898 | 1/1979 | Germany . |
| 8900516 | 3/1989 | Germany . |
| 1571759 | 7/1980 | United Kingdom . |

OTHER PUBLICATIONS

Patent Abstracts of Japan, vol. 15, No. 491 (M–1190) Inventor: Kono Takeshi (Sep 91).

*Primary Examiner*—Kenneth E. Peterson
*Attorney, Agent, or Firm*—Dennison, Scheiner, Schultz & Wakeman

[57] ABSTRACT

A cross cutter for web stock, in particular for a corrugated cardboard web, has tube-shaped cutter cylinders (4, 5) formed of a composite fiber material which are rotatably mounted in pairs above each other in a machine frame (2, 3). Cutter holders (15) for cutters (16) are fastened on the cutter cylinders, which are disposed along the circumference of each cutter cylinder extending diagonally. Counterweights (17) are located on the cutter cylinders opposite the cutter holders. The cutter cylinders mesh with each other via gear wheels (10), by which the cutter cylinders can be driven. The cutter cylinders (4, 5), the cutter holders (15) and the counterweights (17) are made of a composite fiber material with a heat expansion coefficient near or equal to 0 mm/K. The bearings (7) at both ends of the cutter cylinders are fixed bearings. Because of the reduced flexing of the cutter cylinders, the optimum quality of the cut and, because of the reduced mass inertia moment, a reduced energy absorption can be attained by this.

6 Claims, 1 Drawing Sheet

CROSS CUTTER FOR WEB STOCK, IN PARTICULAR FOR A CORRUGATED CARDBOARD WEB

This is a continuation of application Ser. No. 08/159,140 filed on Nov. 30, 1993, now abandoned.

FIELD OF THE INVENTION

The invention relates to a cross cutter for web stock, in particular for a corrugated cardboard web utilizing tube-shaped cutter cylinders formed of a composite fiber material which are rotatably seated in pairs above each other in a machine frame. Cutter holders for the cutters are fastened on the cutter cylinders and are disposed along the circumference of the cutter cylinder extending diagonally. Counterweights on the cutter cylinders are located opposite the cutter holders, and gear wheels are provided which mesh with each other and by means of which the cutter cylinders can be rotatably driven.

BACKGROUND OF THE INVENTION

A cross cutter is known in the art from German Utility Model DE-GM 89 00 516, wherein pipe-shaped cutter cylinders formed of a composite carbon fiber material are rotatably seated in pairs above each other in a machine frame. The cutter holders fastened on each cutter cylinder, along with the cutters and the oppositely located counterweight, are still made of metal. In this case it is disadvantageous that the mass inertia moment of the rotating cutter cylinder system does not allow the highest operational rpm with reduced energy absorption. Furthermore, such a cross cutter does not produce the optimum cutting quality for the web because of the flexing of the cutter cylinders during cutting.

OBJECT AND SUMMARY OF THE INVENTION

It is the object of the invention to produce a cross cutter which assures a high degree of cutting quality for the web and reduces the energy absorption.

The invention offers the advantage that, because of the employment of a composite fiber material with a heat expansion coefficient near or equal to 0 mm/K for the cutter cylinders, cutter holders and the counterweight, there is no longitudinal expansion upon heating and it is therefore possible to employ fixed bearings for both ends of the cutter cylinder. This reduces the flexing of the cutter cylinders and improves the cutting quality. In addition, the mass inertia moment and thus energy absorption is reduced.

It is furthermore possible to use helically cut gear wheels to increase quiet running and to maintain good cutting quality.

The invention offers the further advantage that it is possible to reduce or remove the flexing of the cutter cylinders by the use of stresses similar to those in prestressed concrete.

On the other hand, the invention offers the advantage of influencing the flexing of the cutter cylinder such that the longitudinal expansion occurring with heating causes swelling or warping of the cutter cylinder system.

Further embodiments of the invention ensue from the dependent claims.

The invention will be described in detail below by means of an exemplary embodiment illustrated in the drawings.

DETAILED DESCRIPTION OF THE PREFERRED EMBODIMENT

Figure 1:
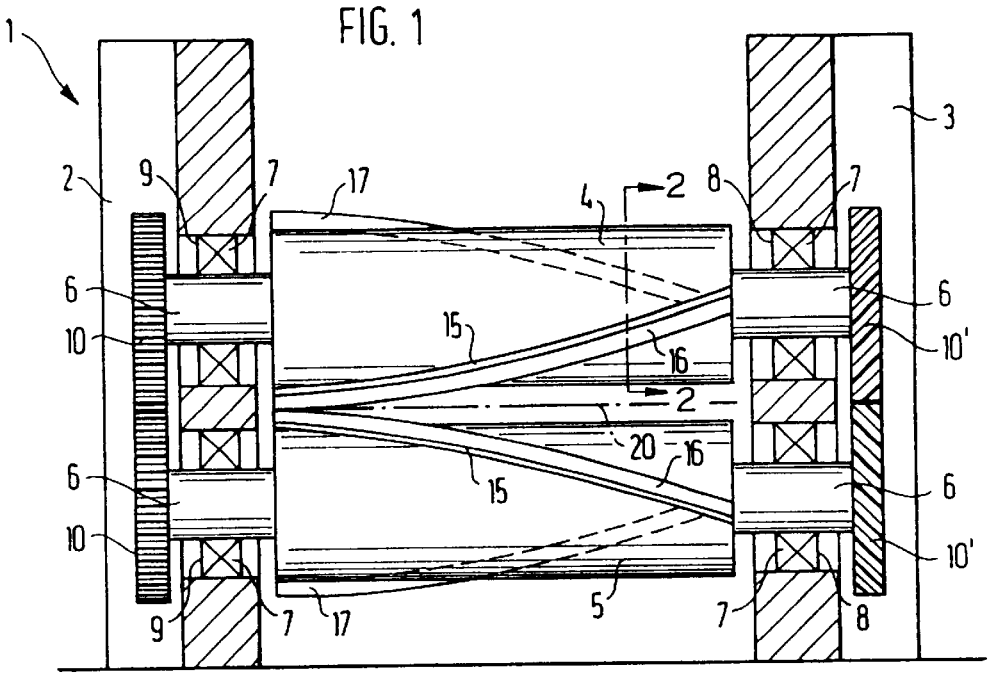
FIG. 1 is a schematic view of a cross cutter in accordance with the invention with parts shown in section.
Figure 2:
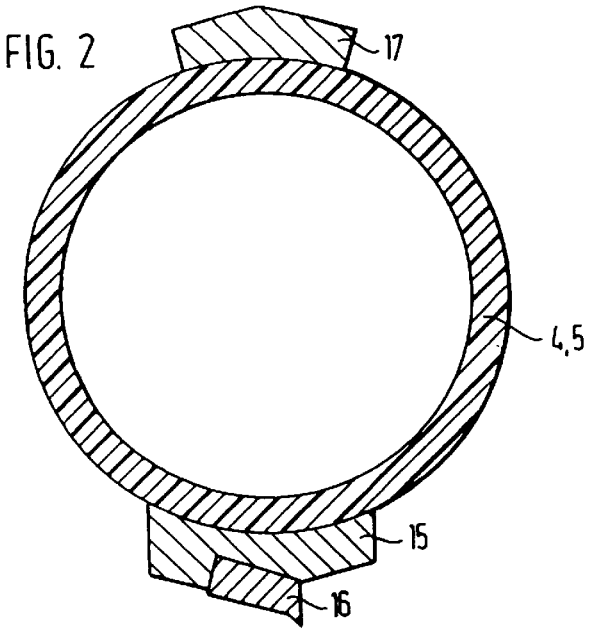
FIG. 2 is a cross section of a single cutter cylinder.

The cross cutter 1, in particular for a corrugated cardboard web 20, has lateral stationary frame cheeks 2, 3. An upper cutter cylinder 4 and a lower cutter cylinder 5 are rotatably supporting in the cheeks. On their ends, the cutter cylinders 4 and 5 have stub shafts 6, which are seated in the frame cheeks 2, 3 by means of bearings 7.

The bearings 7 on the one side are fixed as at 8, the bearings 7 on the other side are movable bearings 9.

The stub shafts 6 mount conventional gear wheels 10 or helically cut gear wheels 10' fixedly connected therewith, which mesh with each other and with a drive gear wheel, not shown.

Each cutter cylinder 4, 5 has a cutter holder 15 extending diagonally along its circumference and mounts cutters 16. These cutters 16 of the two cutter cylinders 4, 5 cooperate for cutting a web 20, the position of the cut moving crosswise over the web 20 based on the path of the cutting edges in the course of the cutting process.

A counterweight 17 is fastened on the cutter cylinders 4 and 5 directly opposite the cutter holder 15.

The cross cutter described up to this point is of a known construction.

The heating of the cutter cylinder system to approximately 60° C., caused by the operation of the cross cutter 1, can be utilized to prevent or to reduce the flexing of the cutter cylinders 4 and 5 during the desired low mass inertia moments. This flexing impairs the quality of the web cut.

In accordance with the invention, the cutter cylinders 4 and 5 are made from a material with a low, preferably a negative, heat expansion coefficient. Suitable for this is a composite fiber material, for example a composite carbon fiber material.

In contrast thereto, the cutter holders 15 and the opposite counterweight 17 are made of a material with high positive heat expansion coefficients. This results in a stress distribution similar to prestressed concrete. Accordingly, the flexing of the cutter cylinder system due to cutting force is considerably reduced.

Usually the cutter cylinders 4 and 5 flex to a greater extent in the center than at the ends because of the cutting force during cross cutting. A reduced contact pressure of the cutters in the center, compared with the ends, results and thus a reduction of the quality of the cut.

The directed choice of the material of the cutter cylinder system results in a high quality cut. It is also possible to select a material with a low heat expansion coefficient for the cutter cylinders 4 and 5, a material with a low heat expansion coefficient for the counterweight 17 and a material with a high heat expansion coefficient for the cutter holder 15. During heating in the course of the operation of the cross cutter, swelling or warping of the cutter cylinders is achieved because of the different longitudinal expansion of the individual components, so that the contact pressure of the cutters 16 required for cutting is maintained in spite of the flexing of the cutter cylinders 4 and 5 occurring because of the cutting force.

If a material with a heat expansion coefficient of 0 mm/K, i.e. with no longitudinal expansion because of temperature changes, is selected for the cutter cylinders 4 and 5 as well as the cutter holders 15 and the counterweight 17, it is possible to employ fixed bearings 8 on both ends of the cutter bar. Flexing of the cutter cylinders 4 and 5 is also considerably reduced by this and the required contact pressure of the cutter 16 for a good cutting quality is maintained.

A composite fiber material, for example a composite carbon fiber material, with a heat expansion coefficient of 0 mm/K is used for the material of the cutter cylinders, cutter holders and the counterweight.

If the cutter cylinders 4 and 5 are made of a material having the same heat expansion coefficient, i.e. the same longitudinal expansion of the upper or lower cutter cylinder 4 and 5 at different temperatures, it is possible to employ helically cut gear wheels 10' at both cutter cylinder ends, resulting in the quieter running of the cutter cylinder system, i.e. no increased flexing amplitudes because of the roll-off action of the gear wheels occur and the contact pressure of the cutter 16 is maintained and in this way a good cut quality is achieved.

To further reduce the mass inertia moment and thus the energy absorption of the cutter cylinder system, the cutter holder 15 is made from a composite fiber material, for example a composite carbon fiber material, with a density of 1.5 km/dm$^3$.

Figure 3:
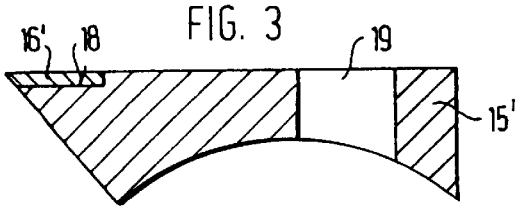
FIG. 3 is a cross section of a cutter holder with a longitudinal recess for the cutter.

In accordance with FIG. 3, the cutter 16' is only embodied at the tip of the cutter holder 15'. A longitudinal recess 18 open towards the outside, can be provided. This cutter 16' consists of a wear-resistant material, preferably steel or a ceramic material. The cutter holder 15' is fastened on the cutter cylinder 4 or 5 by means of screws, not shown, extending through holes 19. A cutter holder 15' of this type with a cutter 16' considerably reduces the mass inertia moment of the cutter cylinder system. By means of this it is possible to increase the working speed and to save energy.

What is claimed:

1. A cross cutter for web stock comprising:

a) a machine frame having opposed fixed bearings;

b) a pair of cutter cylinders rotatably mounted in opposed parallel relationship to each other in said bearings, said cutter cylinders being formed of a composite fiber material having a heat expansion coefficient substantially equal to or less than 0 mm/K;

c) at least one pair of cutter holders formed from said composite fiber material, the members of said pair being mounted on one of said opposing cutter cylinders, said cutter holders being disposed helically along the circumference of said cutter cylinders;

d) at least one pair of cutters, each member of said pair of cutters being mounted on one of said cutter holders;

e) at least one pair of counterweights formed from said composite fiber material, each member of said pair of counterweights being mounted on one of said cutter cylinders at a position opposite to that of said cutter holders; and f) a gear means disposed on each cutter cylinder and in driving contact with each other for transmitting rotational movement to said cutter cylinders.

2. The cross cutter of claim 1, wherein the gear means comprise helically cut gear wheels mounted adjacent to each end of said cutter cylinders.

3. A cross cutter for web stock comprising:

a) a machine frame having opposed bearings, b) a pair of cutter cylinders rotatably mounted in said bearings in opposed parallel relationship to each other, said cutter cylinders being formed of a composite fiber material having a heat expansion coefficient A;

c) at least one pair of cutter holders, the members of said pair being mounted on one of said opposing cutter cylinders, said cutter holders being disposed helically along the circumference of said cutter cylinders, and said cutter holders being formed of a composite fiber material having a heat expansion coefficient B;

d) at least one pair of cutters, each member of said pair of cutters being mounted on one of said cutter holders;

e) at least one pair of counterweights, each member of said pair of counterweights being mounted on one of said cutter cylinders at a position opposite to that of said cutter holders;

f) a gear means disposed on each cutter cylinder and in driving contact with each other for transmitting rotational movement to said cutter cylinders; and g) the relationship between heat expansion coefficients A and B wherein A differs from B creating an expansion differential between said cutter cylinders and said cutter holders at elevated temperatures resulting in the stress of both the cutter cylinder and the cutter holder thereby increasing the rigidity of the cutter holder.

4. A cross cutter as defined in claim 3, wherein the cutter cylinders and the cutter holders are formed of a composite fiber material and the counterweights are formed of metal.

5. A cross cutter for web stock comprising:

a) a machine frame having opposed bearings, b) a pair of cutter cylinders rotatably mounted in said bearings in opposed parallel relationship to each other, said cutter cylinders being formed of a composite fiber material having a predetermined heat expansion coefficient a;

c) at least one pair of cutter holders, the members of said pair being mounted on one of said opposing cutter cylinders, said cutter holders being disposed helically along the circumference of said cutter cylinders, and said cutter holders being formed of a composite fiber material having a heat expansion coefficient b;

d) at least one pair of cutters, each cutter being mounted on one of said cutter holders, and said cutters being formed of a material having a heat expansion coefficient c;

d) a counterweight mounted on each cutter cylinder at a position opposite to that of the cutter holders, and e) at least one pair of counterweights, each member of said pair of counterweights being mounted on one of said cutter cylinders at a position opposite to that of said cutter holders, and said counterweights being formed of a material having a predetermined heat expansion coefficient d;

f) a gear means disposed on each cutter cylinder and in driving contact with each other for transmitting rotational movement to said cutter cylinders; and g) the relationship of heat expansion coefficients a, b, c and d wherein both c and b are greater than both a and d respectively.

6. The cross cutter of claim 5, wherein heat expansion coefficients a and d are negative.

* * * * *